US010926916B2

(12) United States Patent
Cavalcante

(10) Patent No.: US 10,926,916 B2
(45) Date of Patent: Feb. 23, 2021

(54) CRATE WITH RETRACTABLE WALL

(71) Applicant: Rehrig Pacific Company, Los Angeles, CA (US)

(72) Inventor: Mauricio D. Cavalcante, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/202,584

(22) Filed: Mar. 10, 2014

(65) Prior Publication Data

US 2014/0251992 A1 Sep. 11, 2014

Related U.S. Application Data

(60) Provisional application No. 61/775,671, filed on Mar. 10, 2013.

(51) Int. Cl.

| | |
|---|---|
| ***B65D 85/32*** | (2006.01) |
| ***B65D 6/18*** | (2006.01) |
| ***B65D 25/00*** | (2006.01) |

(52) U.S. Cl.

CPC ..... *B65D 11/184* (2013.01); *B65D 25/005* (2013.01)

(58) Field of Classification Search

CPC . B65D 11/18; B65D 11/1806; B65D 11/1813; B65D 11/182; B65D 11/1826; B65D 11/1833; B65D 11/184; B65D 11/1846; B65D 11/1853; B65D 9/12; B65D 9/14; B65D 9/22; B65D 1/243; B65D 2251/1016; B65D 2251/1058

USPC ..... 220/7, 4.33

See application file for complete search history.

(56) References Cited

U.S. PATENT DOCUMENTS

| | | | | |
|---|---|---|---|---|
| 2,780,381 A | | 2/1957 | Burton, Jr. | |
| 3,360,180 A | | 12/1967 | Venturi | |
| 3,372,829 A | | 3/1968 | Averill | |
| 3,835,792 A | | 9/1974 | Wharton | |
| 3,981,410 A | | 9/1976 | Schurch et al. | |
| 4,023,698 A | * | 5/1977 | Joseph | B65D 19/12 217/15 |
| 4,043,476 A | | 8/1977 | Joseph | |
| 4,406,380 A | | 9/1983 | Paige | |
| 4,662,532 A | | 5/1987 | Anderson et al. | |
| 4,674,647 A | | 6/1987 | Gyenge et al. | |
| 4,765,480 A | | 8/1988 | Malmanger | |
| 5,016,772 A | | 5/1991 | Wilk | |

(Continued)

FOREIGN PATENT DOCUMENTS

| | | |
|---|---|---|
| DE | 3500427 A1 | 7/1986 |
| DE | 4319099 A1 | 12/1994 |

(Continued)

*Primary Examiner* — Robert Poon

(74) *Attorney, Agent, or Firm* — Carlson, Gaskey & Olds, P.C.

(57) ABSTRACT

A crate includes a base and a plurality of walls defining a crate interior. The plurality of walls are movable between an upright position and a collapsed position on the base. The plurality of walls include a front wall having a first portion movable between a retracted, open position and a closed position. A latch selectively secures the first portion in the closed position. The latch includes a cantilevered portion having a free end, the free end having a lower wall portion extending downward and then outward of the crate.

5 Claims, 14 Drawing Sheets

(56) References Cited

U.S. PATENT DOCUMENTS

| | | | | |
|---|---|---|---|---|
| 5,161,709 | A * | 11/1992 | Oestreich, Jr. | 220/6 |
| 5,562,224 | A | 10/1996 | Pascal et al. | |
| 5,660,291 | A | 8/1997 | Dash | |
| 6,015,056 | A | 1/2000 | Overholt et al. | |
| 6,044,998 | A * | 4/2000 | Schearer | B65D 19/18 206/600 |
| 6,056,177 | A | 5/2000 | Schneider | |
| 6,098,827 | A | 8/2000 | Overholt et al. | |
| 6,209,742 | B1 | 4/2001 | Overholt et al. | |
| 6,216,872 | B1 * | 4/2001 | Haasbroek | 206/512 |
| 6,290,081 | B1 | 9/2001 | Merey | |
| 6,305,566 | B1 | 10/2001 | Pigott et al. | |
| 6,540,096 | B1 * | 4/2003 | Bazany | B65D 1/225 206/583 |
| 6,601,724 | B1 | 8/2003 | Koefelda et al. | |
| 6,691,885 | B2 | 2/2004 | Brown | |
| 6,843,386 | B2 * | 1/2005 | Raghunathan | B65D 11/1833 220/7 |
| 6,877,628 | B2 * | 4/2005 | Nesting | 220/7 |
| 6,918,502 | B1 | 7/2005 | Overholt et al. | |
| 7,011,225 | B2 | 3/2006 | Oster et al. | |
| 7,100,786 | B2 * | 9/2006 | Smyers | B65D 11/1833 220/6 |
| 7,264,122 | B2 | 9/2007 | Koefelda et al. | |
| 7,641,066 | B2 * | 1/2010 | Baltz | B65D 11/1833 220/6 |
| 8,863,971 | B2 | 10/2014 | Cavalcante et al. | |
| 2002/0070215 | A1 | 6/2002 | Walsh et al. | |
| 2003/0000950 | A1 | 1/2003 | Murakami et al. | |
| 2004/0020821 | A1 | 2/2004 | Koefelda et al. | |
| 2004/0200833 | A1 | 10/2004 | Dubois et al. | |
| 2006/0231555 | A1 | 10/2006 | Smyers | |
| 2006/0260976 | A1 | 11/2006 | Apps | |
| 2007/0158345 | A1 | 7/2007 | Booth et al. | |
| 2009/0057320 | A1 * | 3/2009 | Meers | B65D 11/184 220/660 |
| 2009/0134157 | A1 * | 5/2009 | Meers | B65D 11/184 220/7 |
| 2013/0001223 | A1 * | 1/2013 | Cavalcante et al. | 220/4.01 |

FOREIGN PATENT DOCUMENTS

| | | | |
|---|---|---|---|
| EP | 1225131 | | 5/2004 |
| EP | 1524170 | A2 | 4/2005 |
| EP | 1935792 | A1 | 6/2008 |
| EP | 2062827 | A1 | 5/2009 |
| FR | 1227059 | | 8/1960 |
| FR | 2673910 | | 9/1992 |
| FR | 2810020 | A1 | 12/2001 |
| GB | 2357078 | A | 6/2001 |
| GB | 2360762 | A | 10/2001 |
| GB | 2431922 | A | 5/2007 |
| GB | 2449502 | A | 11/2008 |
| WO | 9521773 | A1 | 8/1995 |
| WO | 9840199 | A1 | 9/1998 |
| WO | 03008275 | A2 | 1/2003 |
| WO | 2006010311 | A1 | 2/2006 |
| WO | 2008145977 | A1 | 12/2008 |

* cited by examiner

CRATE WITH RETRACTABLE WALL

BACKGROUND

The present invention relates generally to containers and more particularly to a crate that is particularly useful for transporting egg cartons or other items to a store.

Currently, egg cartons are shipped to stores in metal crates. The crates must be unloaded onto shelves for the customers to select and purchase. This requires labor for handling the egg cartons in the store. The metal crates are expensive and are damaged easily. They are also subject to rust and are not recyclable. They are also not easily repairable.

SUMMARY

A crate includes a base and a plurality of walls defining a crate interior. The plurality of walls are movable between an upright position and a collapsed position on the base. The plurality of walls include a front wall having a first portion movable between a retracted, open position and a closed position. A latch selectively secures the first portion in the closed position. The latch includes a cantilevered portion having a free end, the free end having a lower wall portion extending downward and then outward of the crate.

According to another feature, a crate includes a base and a plurality of walls defining a crate interior. A latch selectively secures a first portion of one wall in an upright position. The latch includes a hook portion selectively engaging a rib adjacent an aperture having an enlarged portion. The latch is latchable by snapping the hook portion past the rib. The latch is selectively released by sliding the hook portion toward the enlarged portion of the aperture.

According to another feature, a crate includes a base and a plurality of walls defining a crate interior. One of the walls includes a hinge having a hinge pin having a cap. The cap is a portion of increased diameter. The cap is captured outward of a rib, such that the hinge pin and the cap rotate relative to the rib.

BRIEF DESCRIPTION OF THE DRAWINGS

A perspective view of a crate according to one embodiment of the present invention is shown in FIG. 1.

DESCRIPTION OF PREFERRED EMBODIMENTS

Figure 1:
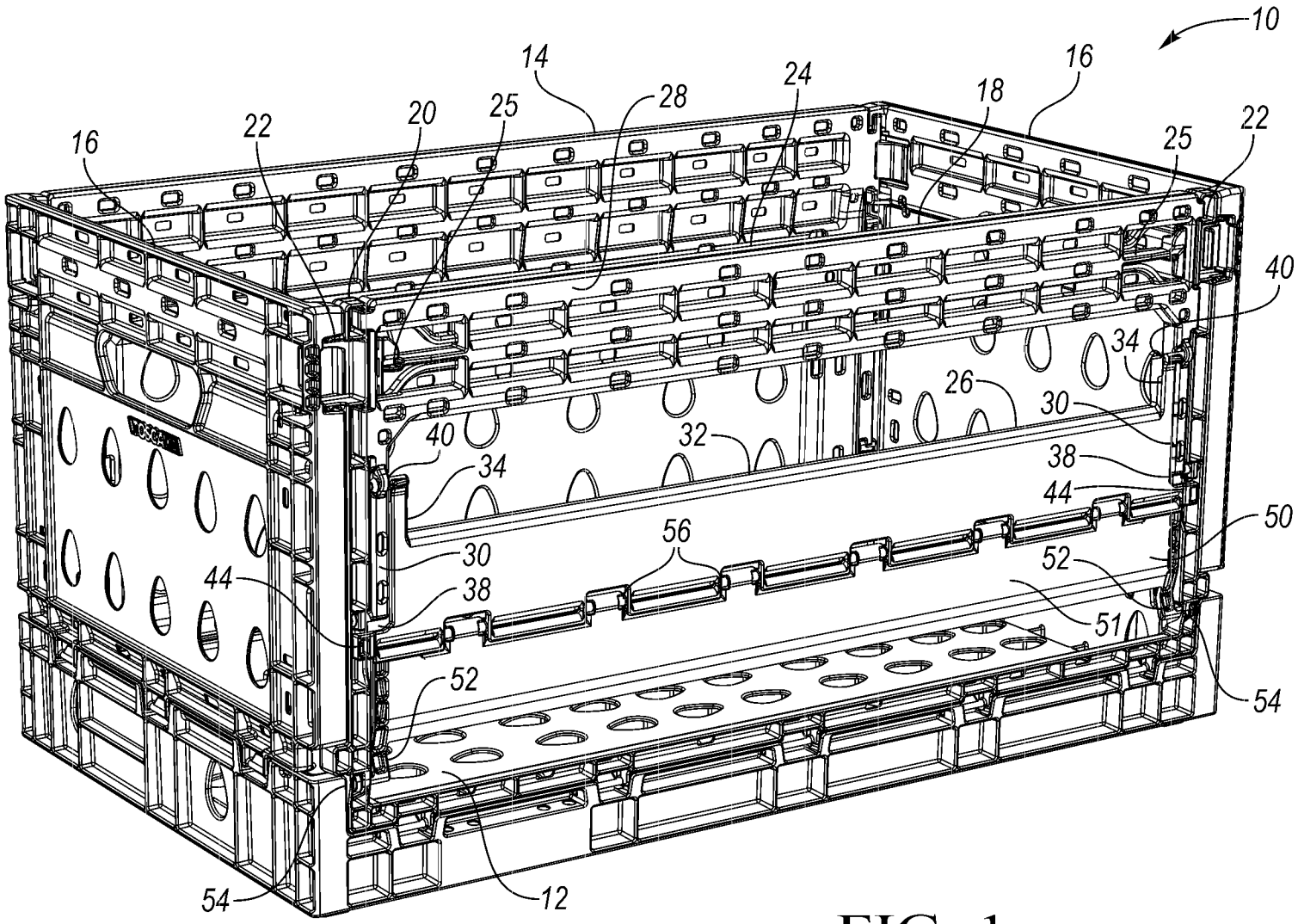

A container 10 according to one embodiment is shown in FIG. 1. In FIG. 1, the container 10 is in an upright, assembled position. The container 10 includes a base 12. A rear wall 14, two end walls 16 and a front wall 18 are pivotably connected at a periphery of the base 12.

The front wall 18 includes a frame 20 pivotably connected to the base 12 and selectively connected to the end walls by latches 22. The front wall 18 further includes an upper (or "first") portion 24, a mid-portion (or "second" portion) 26 and a lower (or "third") portion 50. The upper portion 24 includes a horizontal wall portion 28 and a pair of arms 30 extending downward from ends of the horizontal wall portion 28 (in an inverted U-shape). The upper portion 24 is connected to the frame 20 by a latch 25. The mid-portion 26 includes a horizontal wall portion 32 and a pair of arms 34 extending upward from ends of the horizontal wall portion 32. Upper ends of the arms 34 are attached by hinges 40 to an approximate mid-point on the front of the arms 30 of the upper portion 24 (in an upright U-shape). The arms 30 of the upper portion 24 are pivotably connected to the frame 20 by hinges 38. A mid-portion latch 44 snap-connects each end of the mid-portion 26 to the frame 20.

The lower portion 50 includes a horizontal wall portion 51 and a pair of arms 52 extending downward from ends of the horizontal wall portion 51 to hinges 54 at the lower ends of the arms 52 attached to the frame 20 (in an inverted U-shape). The upper edge of the lower portion 50 is connected to the lower edge of the mid-portion 26 by a hinge 56, such as a living hinge or a snap-fit hinge or other suitable hinge.

In FIG. 1, the walls are in their upright, use position. The front wall 18 is in its deployed, closed position, with the upper portion 24, the mid-portion 26 and the lower portion 50 extending across an upper portion, a mid-portion and a lower portion respectively, of a large opening defined by the frame 20. In the deployed, closed position, the front wall 18 keeps objects, such as egg cartons, in the container 10.

Figure 2:
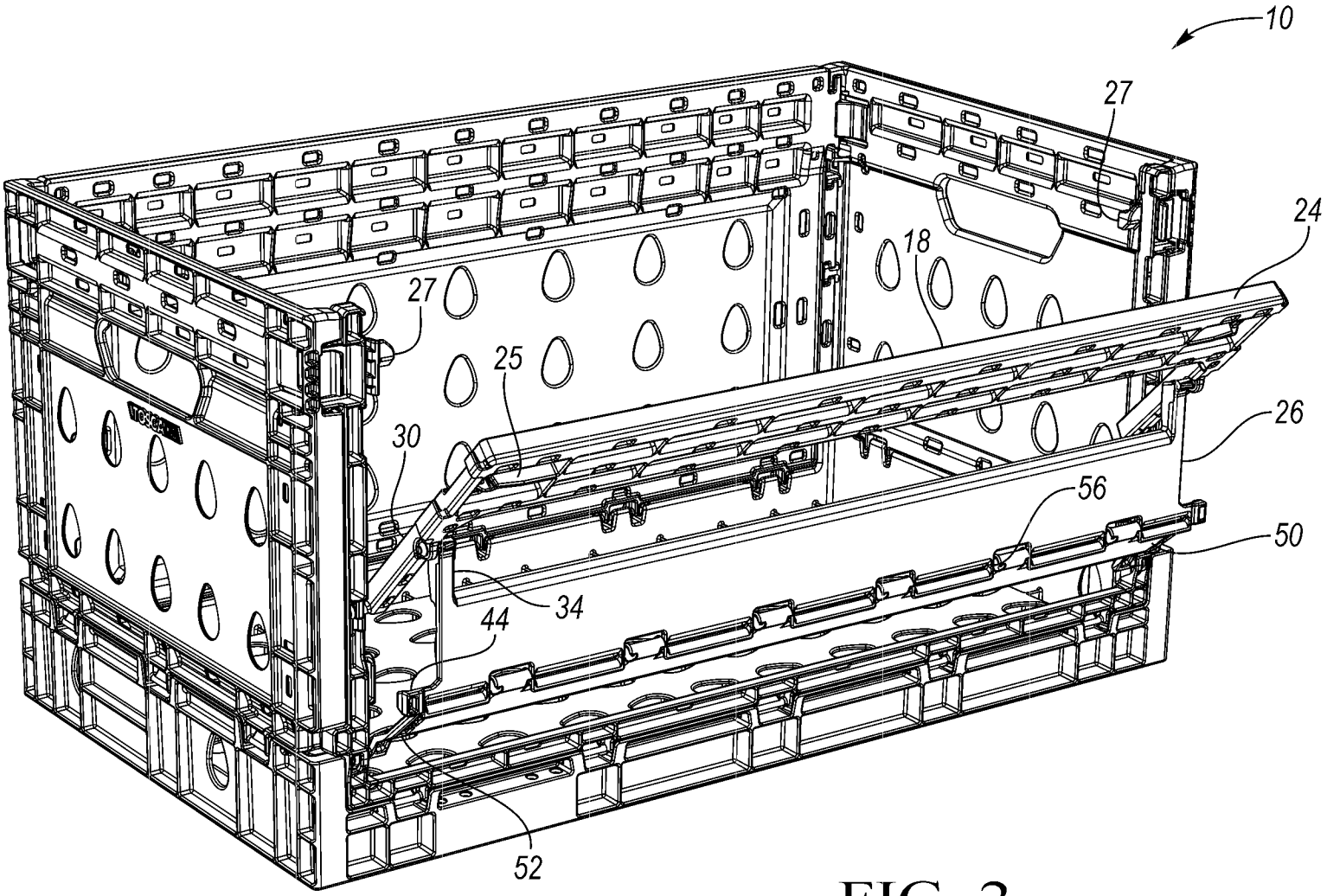
FIG. 2 shows the crate of FIG. 1 with the front wall initially retracting.

In FIG. 2, the upper portion 24 has been pivoted downward and forward slightly about hinges 38 (after releasing latches 25 and latches 44), such that mid-portion 26 and the lower portion 50 (particularly, the hinge 56) move away from the rest of the container 10. In this Figure, the complementary latch receiver 27 to the latch 25 can be seen, the latch receiver 27 on the frame 20 selectively connects the upper portion 24 to the frame 20.

Figure 3:
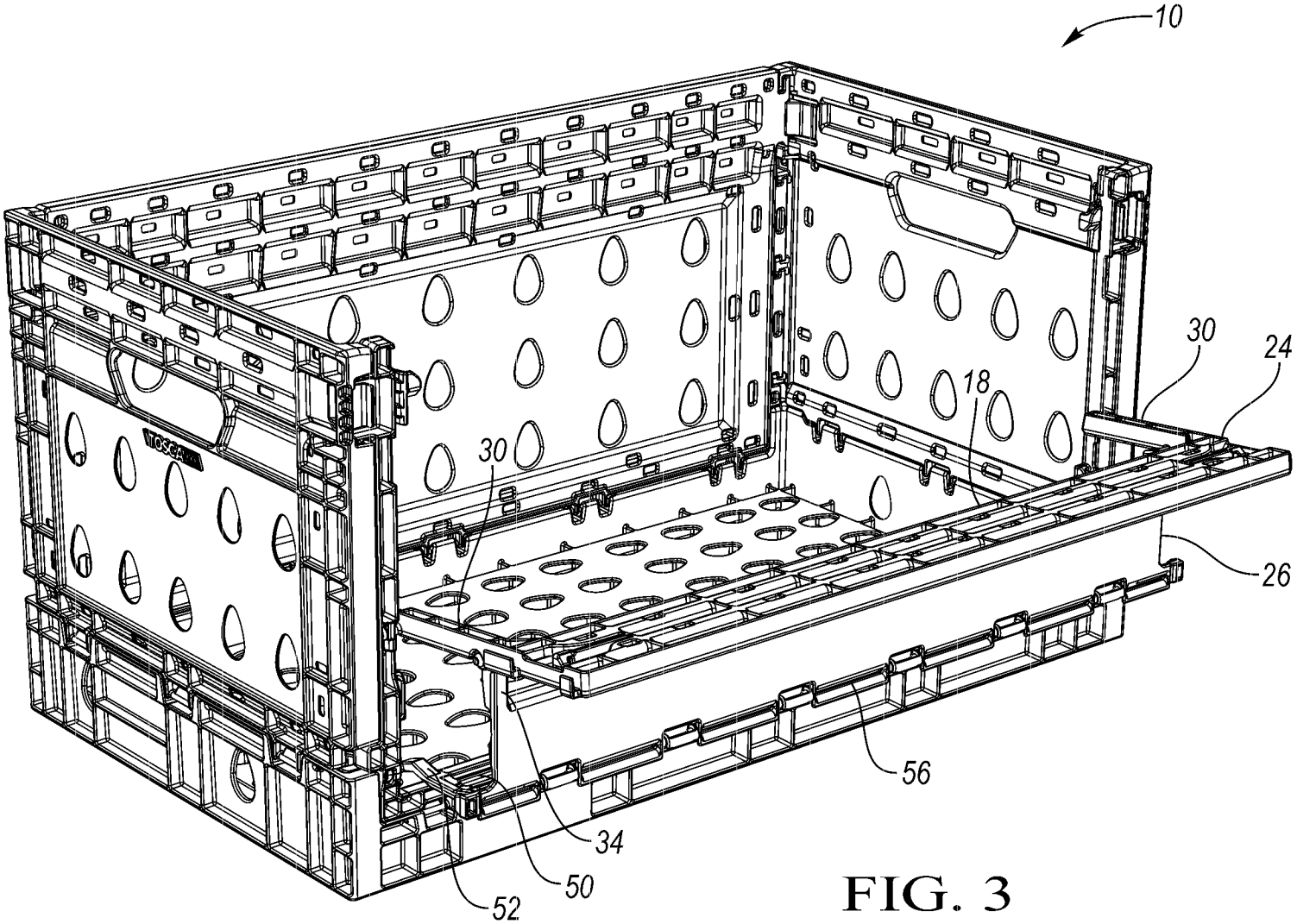
FIG. 3 shows the crate of FIG. 1 with the front wall further retracting.
Figure 4:
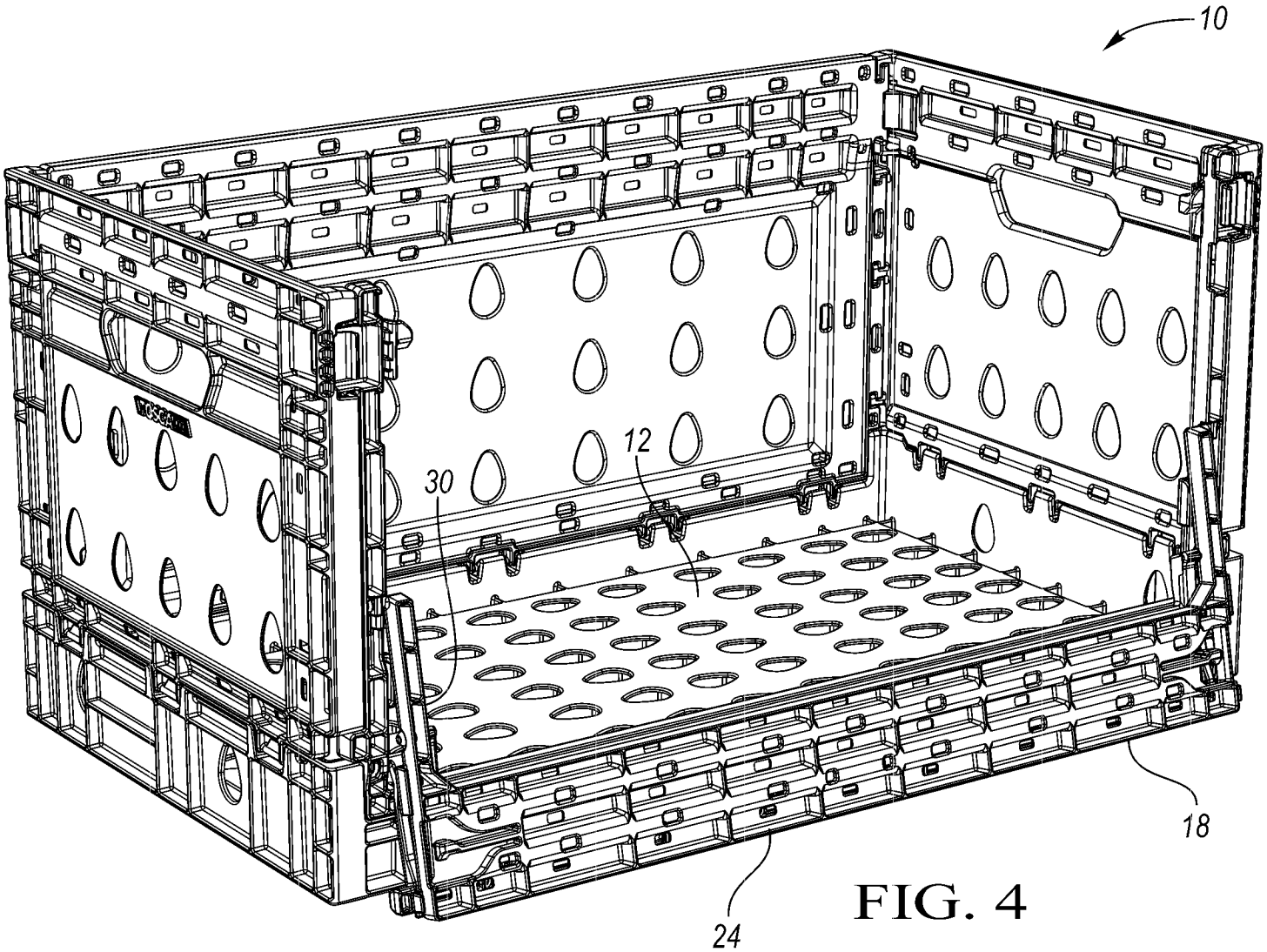
FIG. 4 shows the crate of FIG. 1 with the front wall retracted.

In FIG. 3, the front wall 18 is shown closer to the retracted, open position. The upper portion 24, the mid-portion 26 and the lower portion 50 are then pivoted to a lower position, where the horizontal panel portions 28, 32, 51 are positioned across the bottom of the front wall 18 (and the U-shapes are aligned), as shown in FIG. 4, where the front wall 18 is shown in the retracted, open position. The horizontal wall portion 32 of the mid-portion 26 is substantially aligned with the horizontal wall portion 28 of the upper portion 24 and the horizontal wall portion 51 of the lower portion 50. The front wall 18 is in a retracted, open position, in which consumers can access the contents (such as egg cartons) of the container 10. Note that it is also possible to move the front wall 18 to the retracted, open position even when an identical container is stacked on the container 10.

Figure 5:
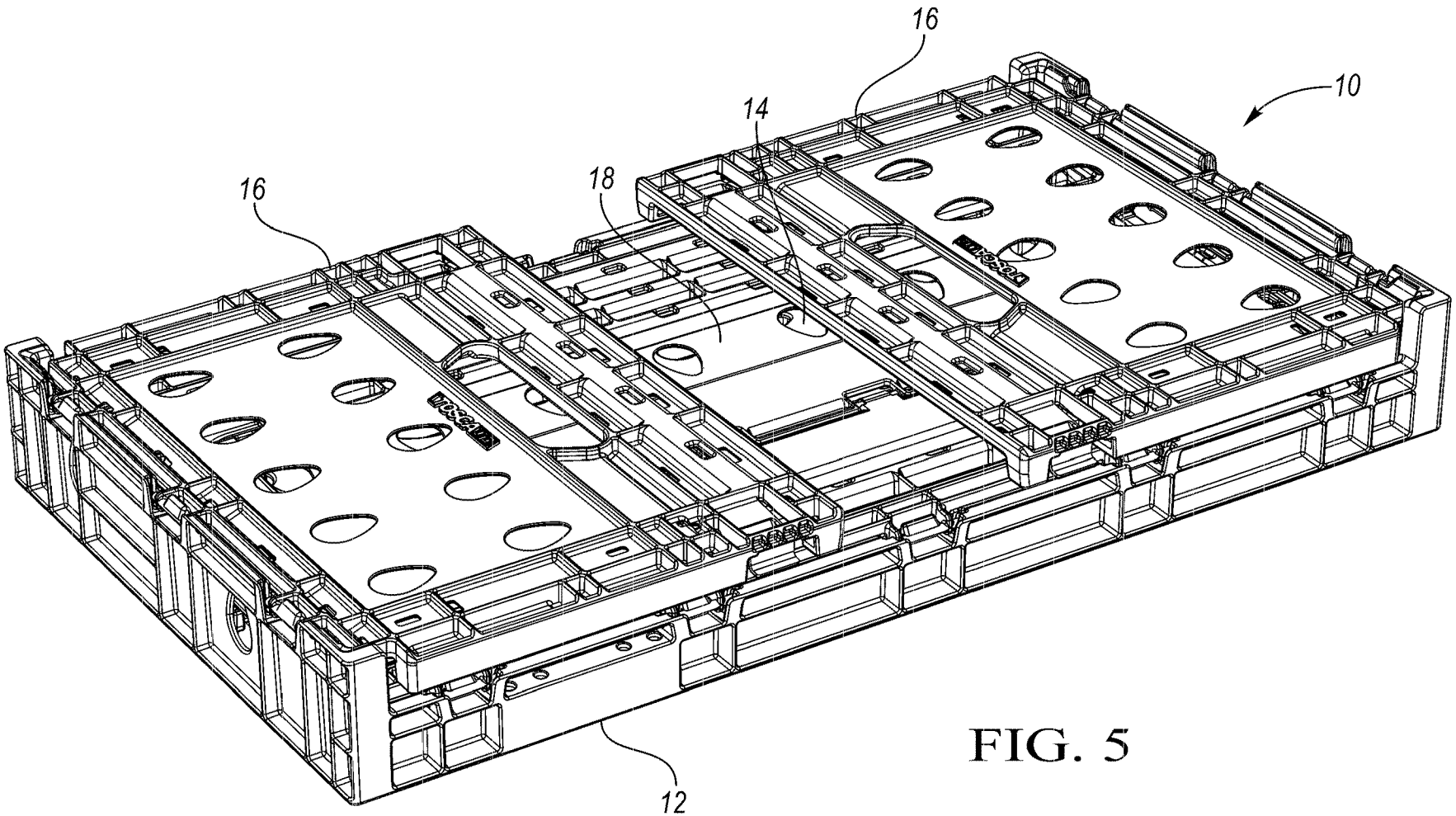
FIG. 5 shows the crate in a collapsed position.

FIG. 5 shows the container 10 in the collapsed or folded position. The front wall 18 and rear wall 14 are pivoted inward onto the base 12. The side walls 16 are pivoted onto the front wall 18 and rear wall 14. In this position, the container 10 occupies the least volume for shipping and storage when the container 10 is empty.

Figure 6:
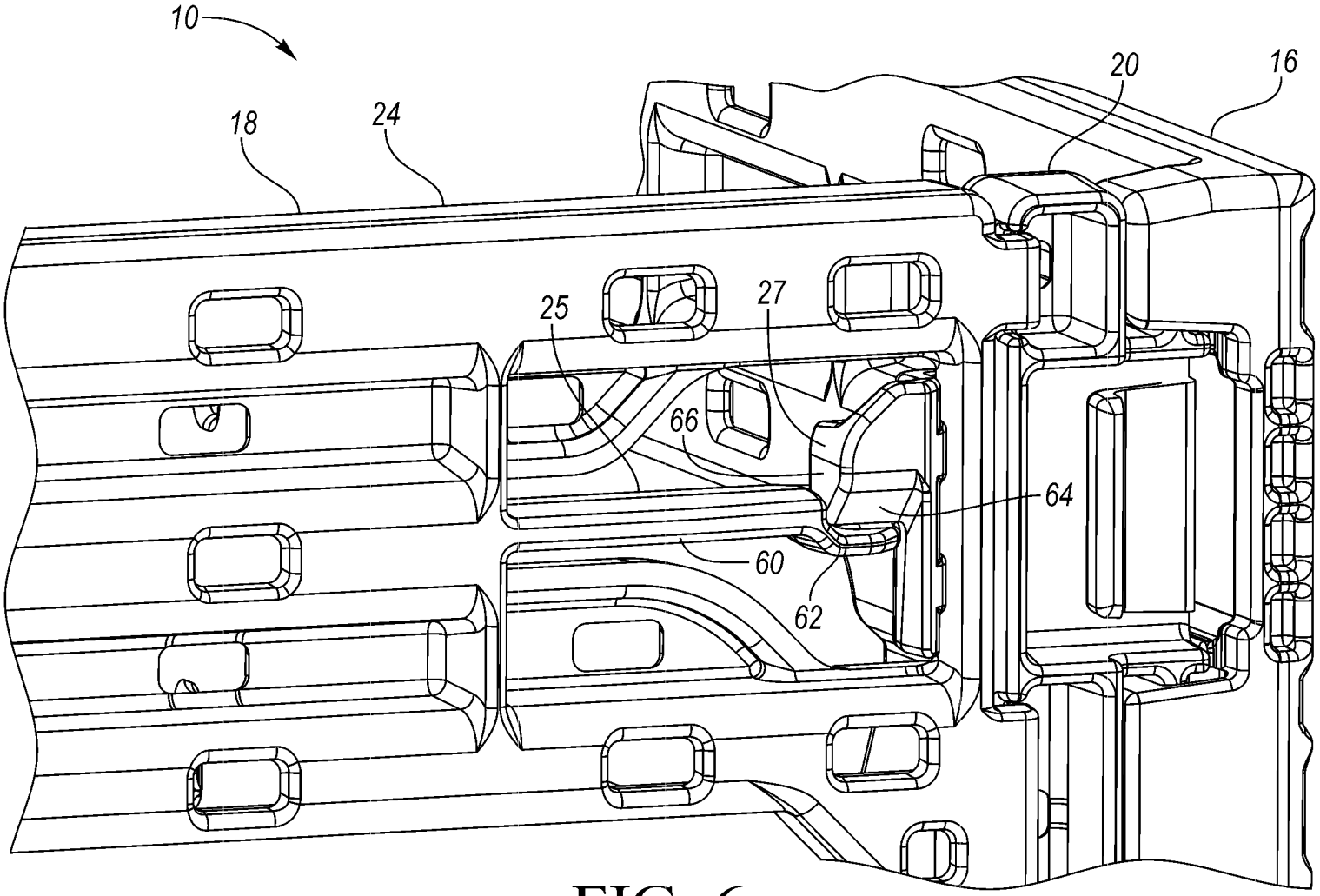
FIG. 6 is an exterior view of one of the latches of the front wall.
Figure 7:
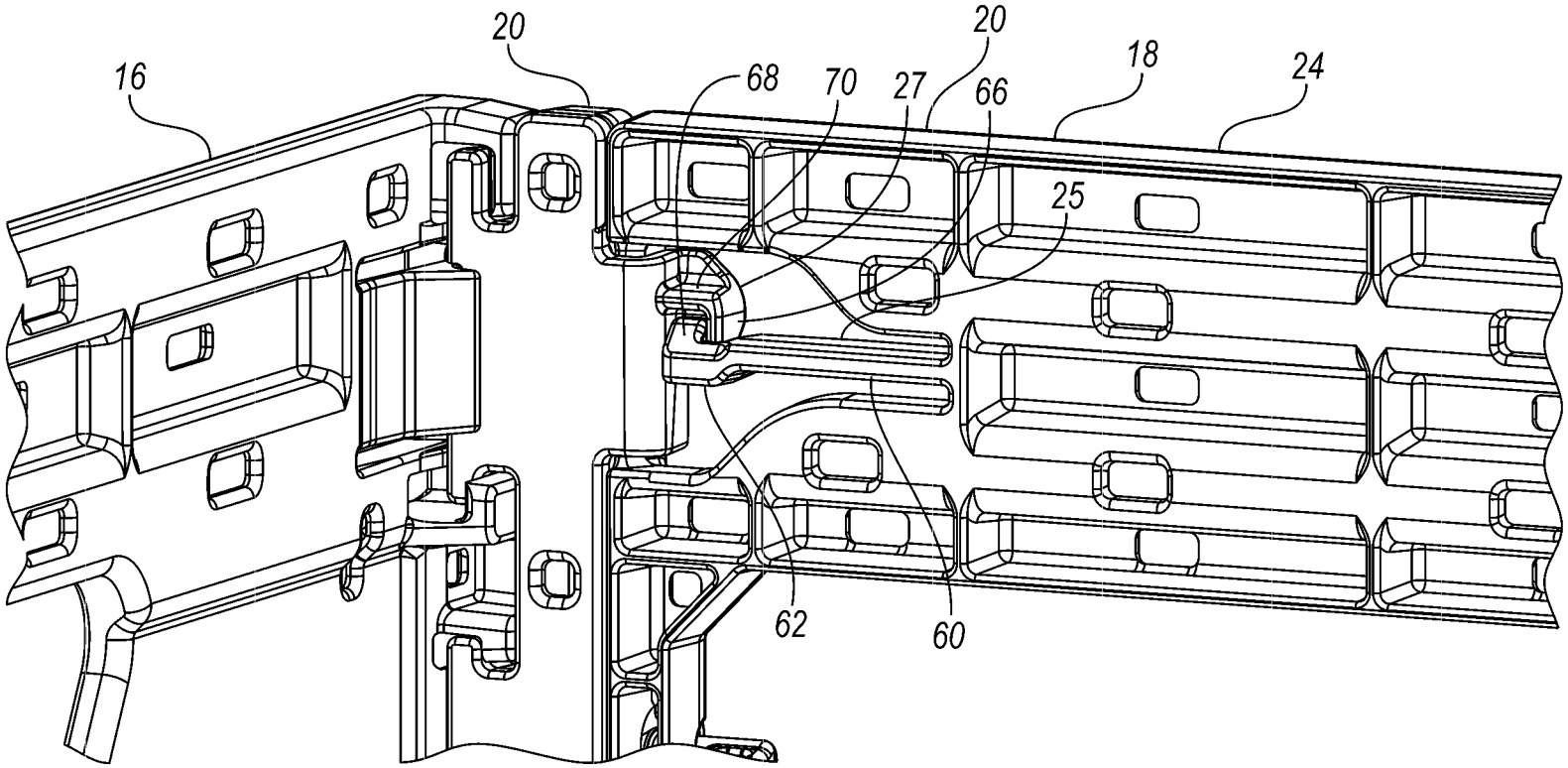
FIG. 7 is an interior view of the latch of FIG. 6.
Figure 8:
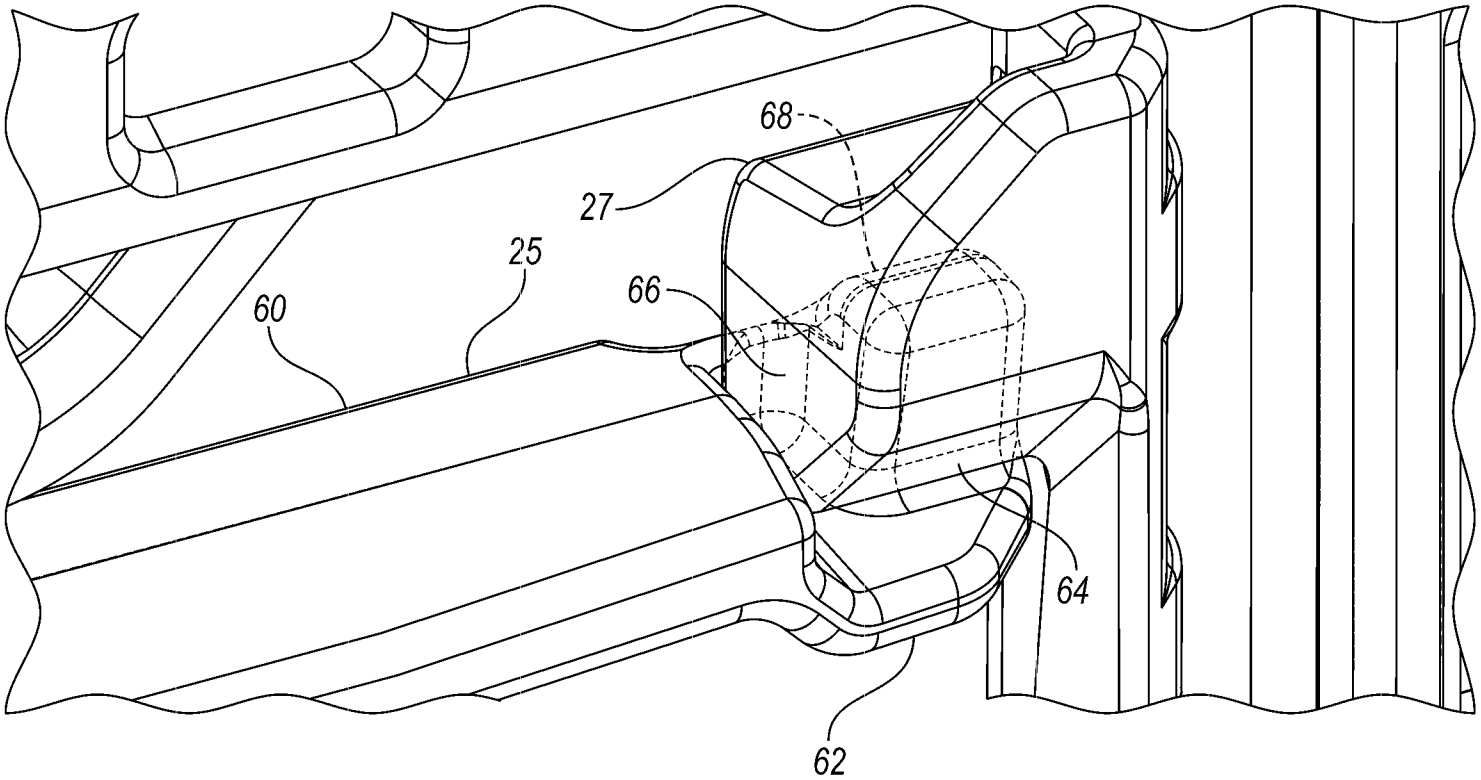
FIG. 8 is an enlarged view of the latch of FIG. 6.

FIGS. 6 and 7 are exterior and interior views, respectively, of one of the latches 25 connecting the upper portion 24 of the front wall 18 to the frame 20. As shown, the latch 25 of the upper portion 24 selectively connects to the latch receiver 27 on the frame 20. The latch 25 includes an elongated, cantilevered portion 60 protruding toward the frame 20. At the free end of the cantilevered portion 60, a lower wall portion 62 extends downward and then outward below the latch receiver 27. The latch receiver 27 projects inward from the frame 20. A lower ramp portion 64 has an outer surface that is angled inward as it extends downward. The latch 27 includes an inner vertical wall portion 66 inward of the ramp 64. As shown in FIG. 7, the latch 25 includes a catch portion 68 projecting upward from the lower wall portion 62. The catch portion 68 includes an inner surface sloped outward as it extends upward. The latch receiver 27 includes an upper rib 70 or stop extending horizontally from the frame 20 to the inner vertical wall portion 66. When latched, the catch portion 68 is received outward of the inner vertical wall portion 66 and below the upper rib 70, as shown in the wireframe view of FIG. 8.

The latch 25 is latched by pressing the upper portion 24 of the front wall 18 into the frame 18, causing the inner sloped surface of the catch portion 68 to contact the ramp portion 64 of the latch receiver 27, which in turn causes the latch 25 to deflect downward. When the latch 25 is past the latch receiver 27, the latch 25 snaps behind the latch receiver 27 as shown in FIGS. 6 and 7. To release, the latch 25 is manually deflected downward until the latch 25 can move forward of latch receiver 27.

Figure 9:
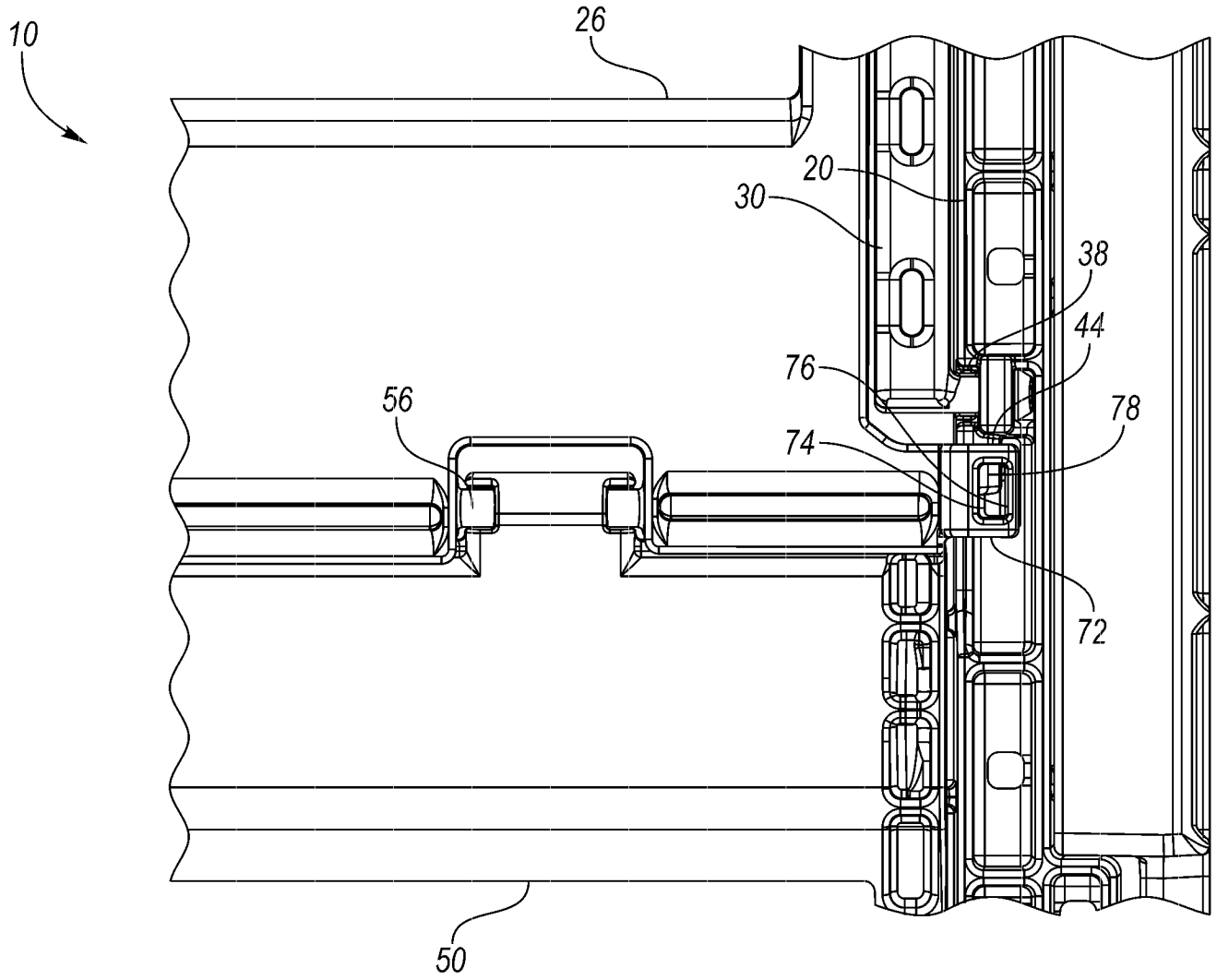
FIG. 9 is a front view of one of the mid-portion latches.

FIG. 9 is an enlarged view of the mid-portion latch 44. The mid-portion 26 includes an outward tab 72 that overlaps the frame 20. The tab 72 includes a hook portion 74 that extends rearward and then inward from an outer edge of the tab 72. The tab 72 may include a central opening 76 behind which the hook portion 74 extends. The frame 20 includes a rib 78 behind which the hook portion 74 can be snap-fit.

Figure 10:
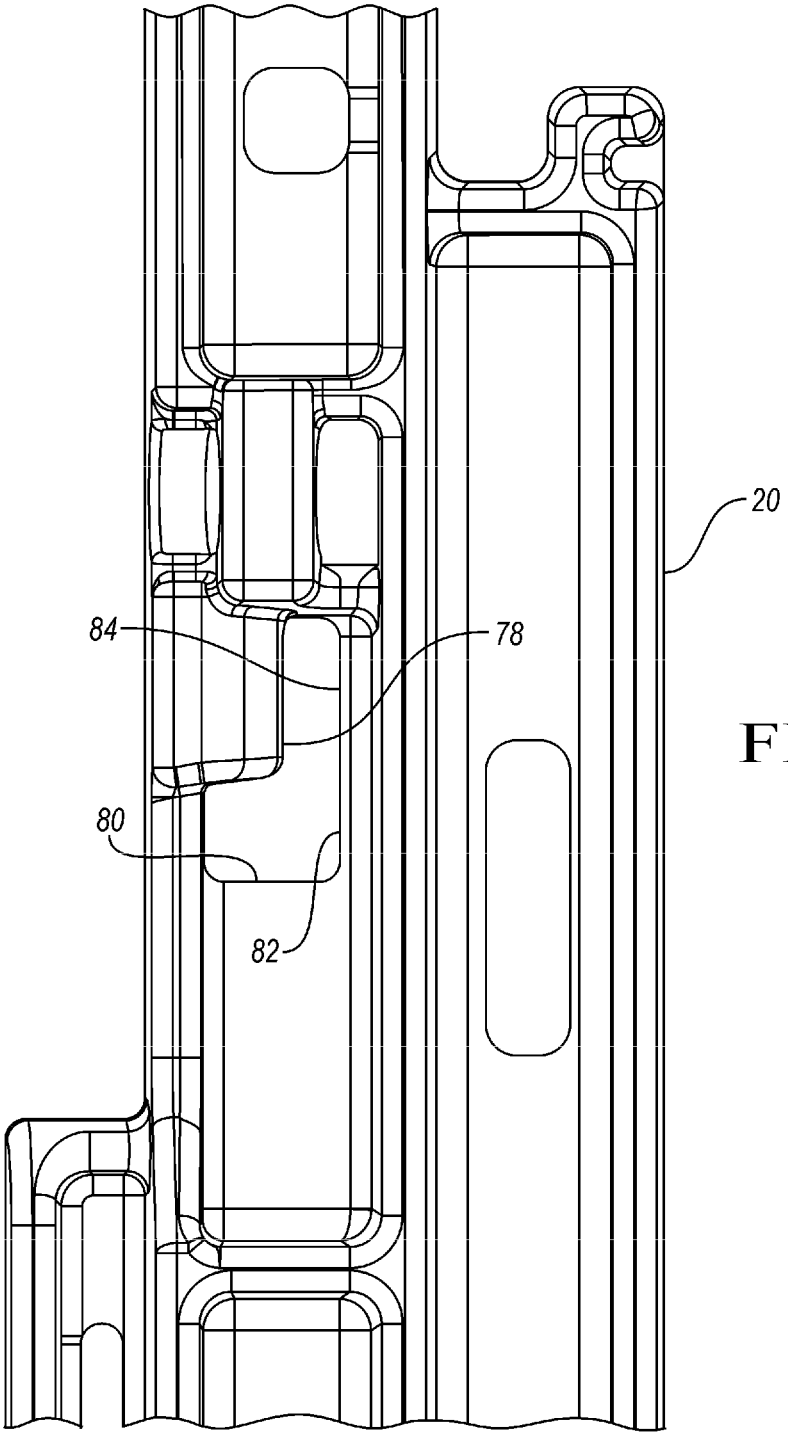
FIG. 10 is an exterior enlarged view of the portion of the frame including the rib of FIG. 9.

FIG. 10 is an exterior enlarged view of the portion of the frame 20 including the rib 78 of FIG. 9. The frame 20 includes an aperture 80 having an enlarged portion 82 below the rib 78 and a narrow portion 84 adjacent the rib 78. The rib 78 may be positioned slightly outward relative to the portion of the frame 20 below the enlarged portion 82.

Figure 11:
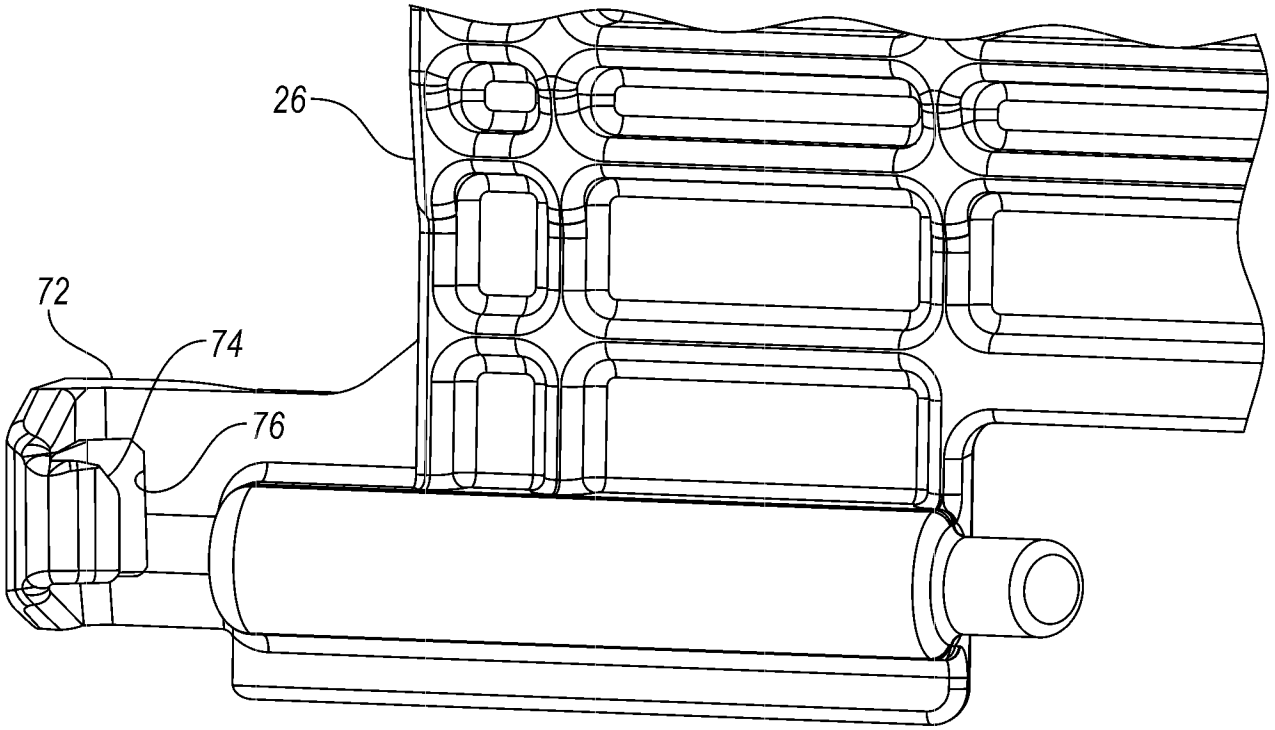
FIG. 11 is an interior enlarged view of the tab of the mid-portion of FIG. 9.

FIG. 11 is an interior enlarged view of the tab 72 of the mid-portion 26. As shown, the hook portion 74 extends rearward and then inward from the outer edge of the tab 72. The central opening 76 may be defined in front of the hook portion 74. The rear surface of the hook portion 74 and/or the front surface of the rib 78 (FIG. 10) may have angled surfaces to facilitate the hook portion 74 snap-fitting behind the rib 78 with pressure placed on the exterior of the latch 44.

Figure 12:
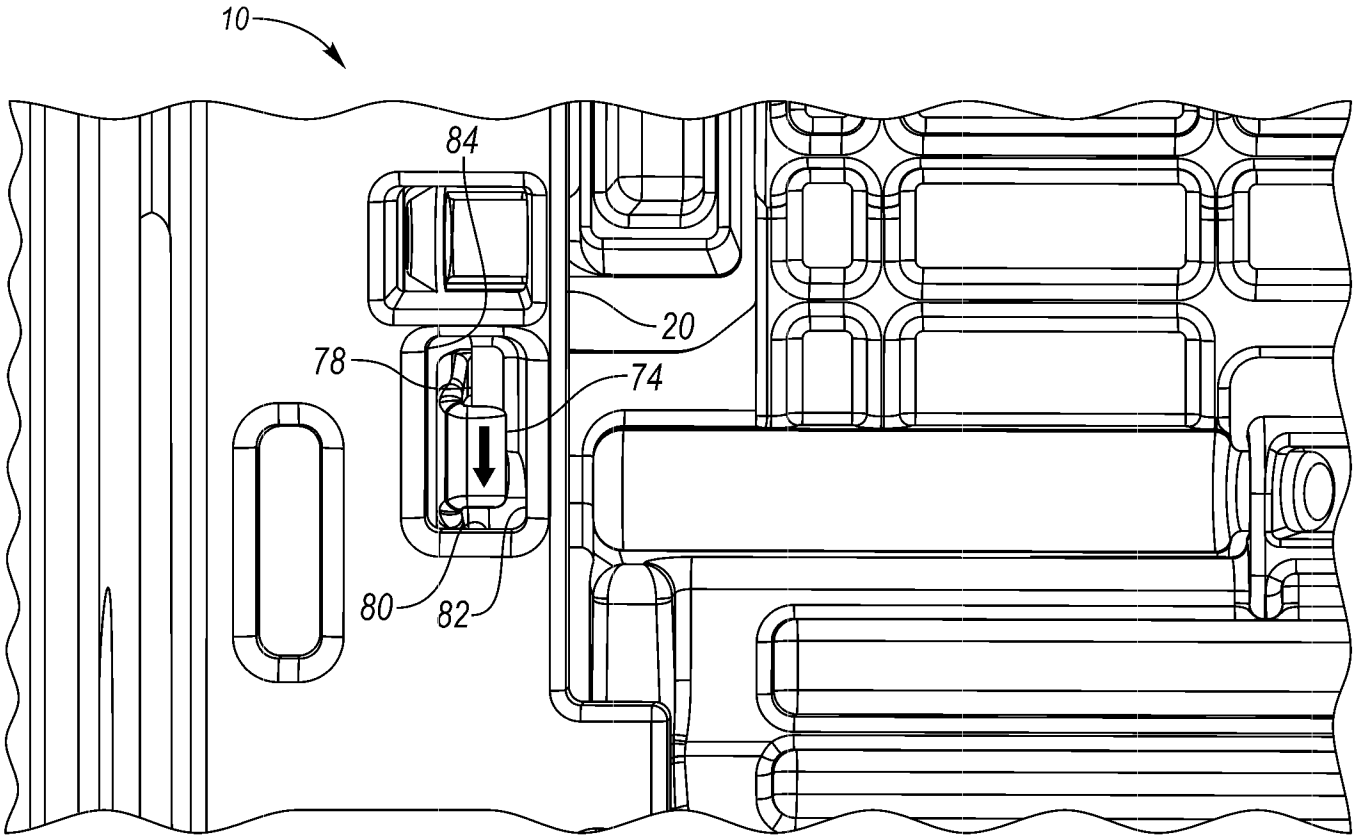
FIG. 12 is an interior view of the latch of FIG. 9.

FIG. 12 is an interior view of the latch 44 of FIG. 9. As shown, the hook portion 74 is snap-fit behind the rib 78. When the upper latches 25 of the front wall 18 are released and the upper portion 24 is pivoted outward, the mid-portion 26 slides down slightly as the hinge 56 moves outward. The causes the hook portion 74 to slide downward below the rib 78 (in the direction of the arrow in FIG. 12) and out the enlarged portion 82 of the aperture 80. In this manner, the latches 44 are self-releasing.

Figure 14:
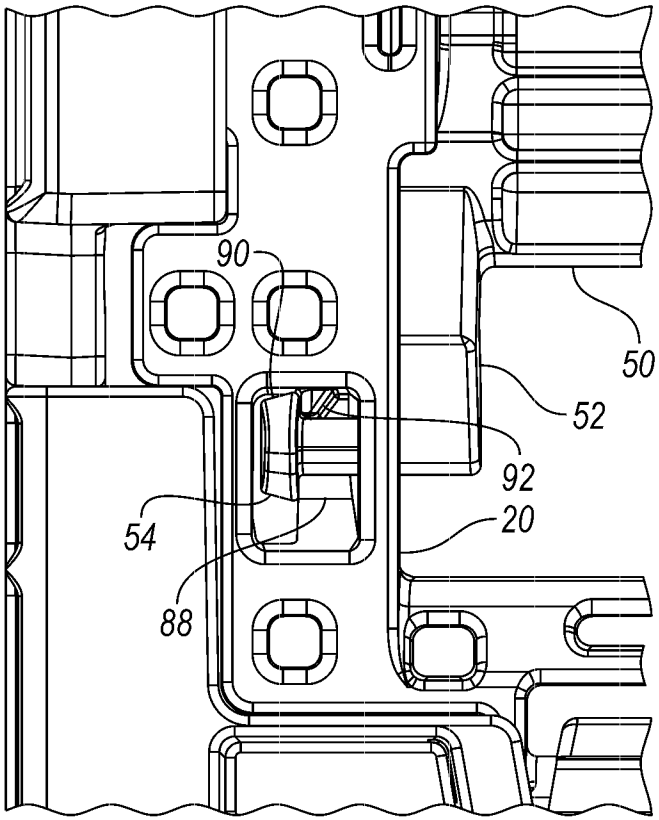
FIG. 14 is an enlarged view of a portion of FIG. 13
Figure 13:
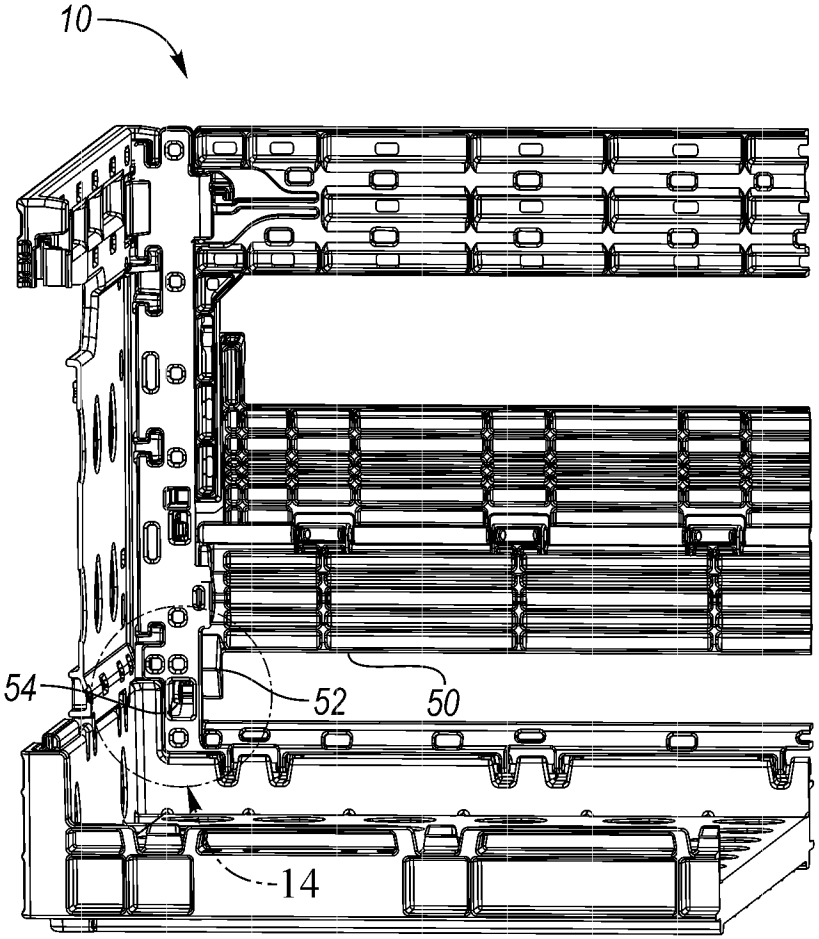
FIG. 13 is an interior view of one of the hinges that connects the lower portion of the front wall to the frame.
Figure 15:
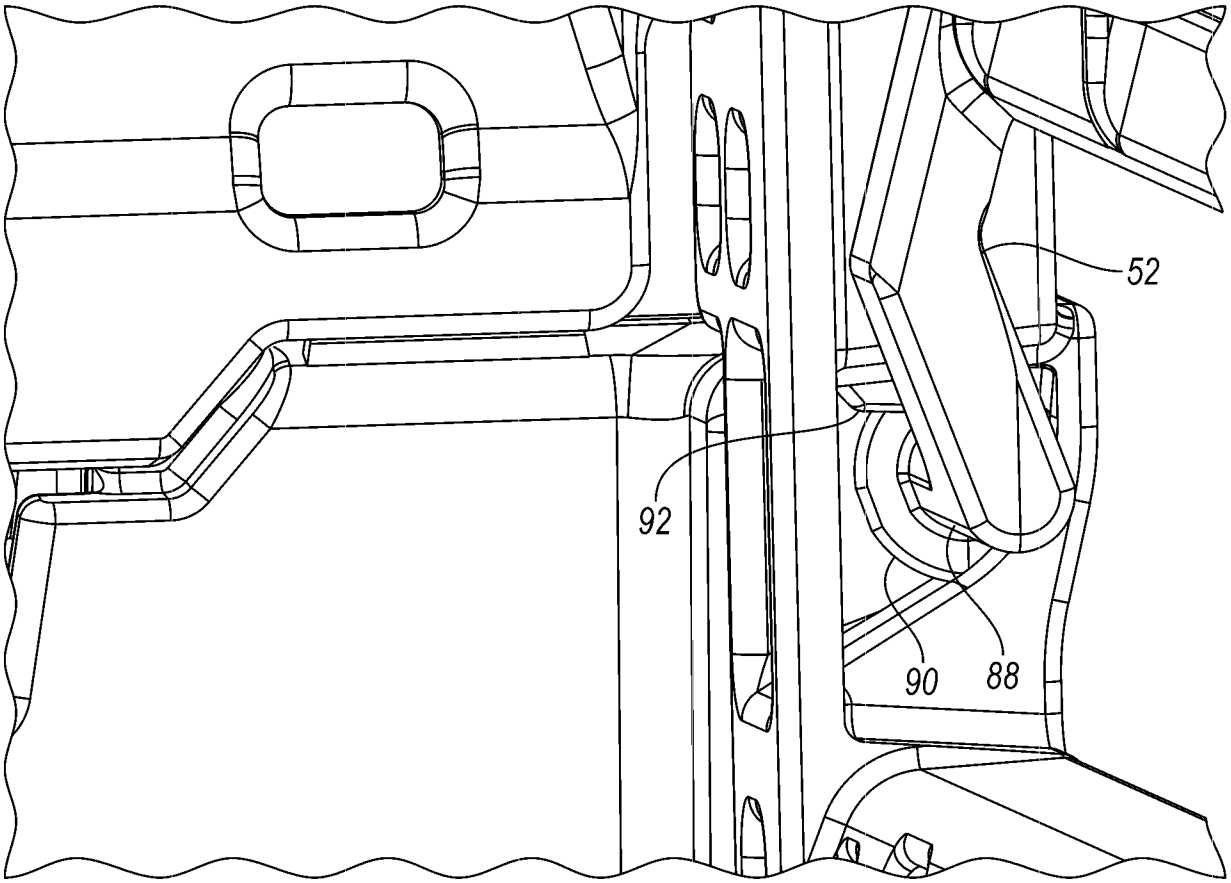
FIG. 15 is an enlarged perspective view of the hinge of FIG. 13.

FIGS. 13-15 show the detail of one of the hinges 54 that connects the lower portion 50 to the frame 20. As shown in FIGS. 14 and 15, the hinge 54 includes a hinge pin 88 integrally molded with the arm 52. The hinge pin 88 includes a cap 90 (a portion of increased diameter) at the end of the hinge pin 88. The cap 90 is slightly tapered toward the outer end, to facilitate snap-fit assembly. The cap 90 is captured outward of a rib 92 formed in the frame 20, such that the hinge pin 88 can rotate relative to the frame 20. The rib 92 prevents the hinge pin 88 from being released during use.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A crate comprising:

a base;

a plurality of walls defining a crate interior, the plurality of walls movable between an upright position and a collapsed position on the base, the plurality of walls including a front wall having a first portion movable between a retracted, open position and a closed position, the front wall further including a frame and a second portion, wherein the first portion and the second portion each include a horizontal wall portion and a pair of arms, wherein the first portion is hingeably connected to the frame and the second portion is hingeably connected to the first portion, wherein the front wall includes a third portion hingeably connected to the second portion and hingeably connected to the frame; and a latch selectively securing the first portion in the closed position, the latch including a cantilevered portion having a free end, the free end having a lower wall portion extending downward and then outward of the crate.

2. The crate of claim 1 wherein the plurality of walls includes a pair of opposed end walls and wherein the frame includes spaced apart vertical portions selectively latchable to the end walls, the first portion disposed between the vertical portions of the frame.

3. The crate of claim 2 wherein the latch selectively secures the first portion to one of the vertical portions of the frame.

4. A crate comprising:

a base;

a plurality of walls including a front wall, wherein the front wall includes an upper portion, a mid-portion and a lower portion, wherein the upper portion is pivotably connected to the mid-portion, and wherein the mid-portion is pivotably connected to the lower portion, wherein the plurality of walls includes a pair of opposed end walls and wherein the front wall includes a frame hingeably connected to the base, the frame including spaced apart vertical portions selectively latched to the end walls, the upper portion hingeably connected to the frame and disposed between the vertical portions of the frame, wherein the lower portion is hingeably connected to the frame, wherein the upper portion, the mid-portion and the lower portion each include a horizontal wall portion and a pair of arms; and a latch selectively securing the front wall in a deployed, closed position, the latch including a hook portion selectively engaging a rib adjacent an aperture having an enlarged portion, wherein the latch is latchable by snapping the hook portion past the rib and wherein the latch is selectively releasable by pivoting the upper portion outward thereby causing the hook portion to slide toward the enlarged portion of the aperture.

5. The crate of claim 4 wherein the mid-portion is connected to the lower portion by a hinge and wherein the latch is released by sliding the hook portion toward the enlarged portion of the aperture by pivoting the hinge outward of the crate.

* * * * *